United States Patent [19]

Cushman et al.

[11] Patent Number: 4,525,292

[45] Date of Patent: Jun. 25, 1985

[54] BLEACHING DETERGENT COMPOSITIONS COMPRISING SULFOSUCCINATE BLEACH PROMOTERS

[76] Inventors: Mark E. Cushman; Lawrence A. Gilbert, both of c/o Procter & Gamble, ITC, Cincinnati, Ohio 45217

[21] Appl. No.: 472,689

[22] Filed: Mar. 7, 1983

[51] Int. Cl.[3] ..... C11D 7/54

[52] U.S. Cl. ..... 252/102; 252/95; 252/98; 252/99; 252/186.38; 252/186.39

[58] Field of Search ..... 8/107, 111; 252/98, 252/99, 102, 528, 538, 546, 557, 95, 186.38, 186.39

[56] References Cited

U.S. PATENT DOCUMENTS

| | | | |
|---|---|---|---|
| 3,640,874 | 2/1972 | Gray | 252/95 |
| 3,785,984 | 1/1974 | Berg et al. | 252/99 |
| 3,840,466 | 10/1974 | Gray | 252/99 |
| 4,003,700 | 1/1977 | Gray et al. | 8/111 |
| 4,120,809 | 10/1978 | Murray | 252/102 |
| 4,128,490 | 12/1978 | Finley et al. | 252/95 |
| 4,145,183 | 3/1979 | Bostwick | 8/111 |
| 4,231,890 | 11/1980 | Yagi et al. | 252/99 |
| 4,283,301 | 8/1981 | Diehl | 252/102 |
| 4,391,725 | 7/1983 | Bossu | 252/90 |

*Primary Examiner*—Prince E. Willis

[57] ABSTRACT

This invention relates to bleaching detergent compositions that provide effective and efficient surface bleaching of textiles over a wide range of bleach detergent solution temperatures. Surface bleaching of textiles is bleaching wherein the bleaching mechanism takes place on the textile surface and, thereby, removes stains and/or soils. The bleaching compositions within the invention contain either a mixture of peroxygen bleaches capable of yielding hydrogen peroxide in aqueous solutions and specific bleach activators or the corresponding percarboxylic acids and either a sulfosuccinate, a nitrilotriacetate or mixtures thereof as a bleach promoter.

18 Claims, No Drawings

BLEACHING DETERGENT COMPOSITIONS COMPRISING SULFOSUCCINATE BLEACH PROMOTERS

TECHNICAL FIELD

This invention relates to bleaching detergent compositions. More particularly, this invention relates to bleaching detergent compositions that provide effective and efficient surface bleaching of textiles over a wide range of bleach detergent solution temperatures. Surface bleaching of textiles is bleaching wherein the bleaching mechanism takes place on the textile surface and, thereby, removes stains and/or soils. The bleaching detergent compositions within the invention contain either peroxygen bleaches capable of yielding hydrogen peroxide in aqueous solutions and specific bleach activators or percarboxylic acids corresponding to the percarboxylic acids resulting from the activator/bleach interaction.

It has long been known that peroxygen bleaches are effective for stain and/or soil removal from textiles, but that they are also extremely temperature dependent. Such bleaches are essentially only practicable and/or effective in bleaching solutions, i.e., a bleach and water mixture, wherein the solution temperature is above about 60° C. At bleach solution temperatures of about 60° C. peroxygen bleaches are only partially effective and, therefore, in order to obtain a desirable level of bleaching performance extremely high levels of peroxygen bleach must be added to the system. This is economically impracticable. As the bleach solution temperature is lowered below 60° C., peroxygen bleaches are rendered ineffective, regardless of the level of peroxygen bleach added to the system. The temperature dependence of peroxygen bleaches is significant because such bleaches are commonly used as a detergent adjuvant in textile wash processes that utilize an automatic household washing machine at wash water temperatures below 60° C. Such wash temperatures are utilized because of textile care and energy considerations. As a consequence of such a wash process, there has been much industrial research to develop substances, generally referred to as bleach activators, that render peroxygen bleaches effective at bleach solution temperatures below 60° C. Numerous substances have been disclosed in the art as effective bleach activators. The corresponding percarboxylic acids can also be used.

BACKGROUND ART

Carboxylic acid ester bleach activators are known. U.K. Pat. No. 864,798, Hampson et al (Apr. 6, 1961), discloses bleaching compositions comprising an inorganic persalt and an organic ester of an aliphatic carboxylic acid wherein the size of the carboxylic acid ester particles is such that at least 70% of them are retained on a 60 mesh British Standard sieve. It is preferred that the ester be derived from an aliphatic carboxylic acid having not more than 10, preferably less than 8, carbon atoms. The proportion of molecules of reactive ester to each atom of available oxygen in the persalt is from $\frac{1}{4}$ to 4 and preferably from $\frac{1}{2}$ to 1.5. It is stated that such bleaching compositions are stable during storage.

U.K. Pat. No. 836,988, Davies et al (June 9, 1960), discloses bleaching compositions containing hydrogen peroxide or inorganic persalt and organic carboxylic esters. A test is described to define the esters within the invention. The molecules of ester per one atom of available oxygen are from $\frac{1}{4}$ to 2 and particularly from $\frac{1}{2}$ to 1.5. It is stated that such esters provide improved bleaching at temperatures from 50° C. to 60° C. relative to that obtained with the persalt alone.

It is also known that the bleach activators that are believed to exhibit surface activity that are utilized in combination with peroxygen bleaches provide particularly effective surface bleaching. U.S. Pat. No. 4,283,301, Diehl (Aug. 11, 1981), discloses bleaching compositions comprising a peroxygen bleach and a bleach activator of the general formula:

$$R-\overset{\overset{\displaystyle O}{\|}}{C}-Z \quad \text{or} \quad Z-\overset{\overset{\displaystyle O}{\|}}{C}-R^2-\overset{\overset{\displaystyle O}{\|}}{C}-Z$$

wherein R is an alkyl chain containing from about 5 to about 13 carbon atoms, $R^2$ is an alkyl chain containing from about 4 to about 24 carbon atoms and each Z is a leaving group as defined therein. It is preferred that such bleaches and bleach activators are present in equimolar ratios.

SUMMARY OF THE INVENTION

The present invention comprises a bleaching detergent composition containing:

I. a bleaching system which provides from about 0.03% to about 1.3% available oxygen, said system being selected from the group consisting of:

(a) a mixture of a peroxygen bleaching compound capable of yielding hydrogen peroxide in an aqueous solution; and a bleach activator having the general formula:

$$R-\overset{\overset{\displaystyle O}{\|}}{C}-L$$

wherein R is an alkyl group containing from about 5 to about 18 carbon atoms wherein the longest linear alkyl chain extending from and including the carbonyl carbon contains from about 5 to about 10 carbon atoms and L is a leaving group, the conjugate acid of which has a $pK_a$ in the range of from about 6 to about 13;

wherein, preferably, the molar ratio of hydrogen peroxide yielded by the bleaching compound to bleach activator is greater than about 1.5 or (b) a percarboxylic acid having the general formula $$R-\overset{\overset{\displaystyle O}{\|}}{C}-OOH$$

where R has the meaning given hereinbefore;

II. from about 2% to about 60% of a detergent surfactant; and

III. at least about $\frac{1}{4}$% of a bleach promoter selected from the group consisting of water soluble sulfosuccinates, nitrilotriacetates and mixtures thereof.

DETAILED DESCRIPTION OF THE INVENTION

This invention relates to bleaching detergent compositions which provide improved bleach effectiveness because of the presence of the percarboxylic acids and the bleach promoters. Such compositions provide extremely effective and efficient surface bleaching of textiles which thereby remove stains and/or soils from the textiles. The compositions are particularly effective at removing dingy soils from textiles. Dingy soils are soils that build up on textiles after numerous cycles of usage and washing and, thus, result in a white textile having a gray tint. These soils tend to be a blend of particulate and greasy materials. The removal of this type of soil is sometimes referred to as "dingy fabric clean up".

The bleaching detergent compositions provide such bleaching over a wide range of bleach solution temperatures. Such bleaching is obtained in bleach solutions wherein the solution temperature is at least about 5° C. Without the bleach activator, peroxygen bleaches would be ineffective and/or impracticable at temperatures below about 60° C.

The bleaching compositions within the invention are extremely efficient. Without being bound by theory, it is believed that such efficiency is achieved because the bleach activators and/or percarboxylic acids within the invention exhibit surface activity. This can be explained as follows.

The bleaching mechanism generally, and the surface bleaching mechanism in particular, are not completely understood. However, it is generally believed that the bleach activator undergoes nucleophilic attack by a perhydroxide anion, which is generated from the hydrogen peroxide evolved by the peroxygen bleach, to form a percarboxylic acid. This reaction is commonly referred to as perhydrolysis. The percarboxylic acid then forms a reactive dimer with its anion which, in turn, evolves a singlet oxygen which is believed to be the active bleaching component. It is theorized that the singlet oxygen must be evolved at or near the textile surface in order to provide surface bleaching. Otherwise, the singlet oxygen will provide bleaching, but not at the textile surface. Such bleaching is known as solution bleaching, i.e., the bleaching of soils in the bleach solution.

To ensure that the singlet oxygen is more efficiently evolved at the textile surface, it is essential that the longest linear alkyl chain extending from and including the carbonyl carbon of the percarboxylic acid have from about 5 to about 10 carbon atoms. Such percarboxylic acids are surface active and, therefore, tend to be concentrated at the textile surface. Percarboxylic acids containing fewer carbon atoms in such alkyl chain have similar redox potentials, but do not have the ability to concentrate at the textile surface. Therefore, the bleach activators within the invention are extremely efficient because much lower levels, on a molar basis, of such bleach activators are required to get the same level of surface bleaching performance as with similar bleach activators containing fewer carbon atoms in such an alkyl chain, which are not within the invention.

It is also believed, based upon the same theory as outlined directly above, that the bleach activators within the invention can render peroxygen bleaches more efficient even at bleach solution temperatures wherein bleach activators are not necessary to activate the bleach, i.e., above about 60° C. Therefore, with bleach compositions of the invention, less peroxygen bleach is required to get the same level of surface bleaching performance as is obtained with the peroxygen bleach alone.

Optimum surface bleaching performance is obtained with bleaching solutions wherein the pH of such solution is between about 8 and 10.5 and preferably between 9 and 10. It is preferred with some activators that such pH be greater than 9 not only to optimize surface bleaching performance, but also to prevent the bleaching solution from having an undesirable odor. It has been observed that once the pH of the bleaching solution drops below 9, the bleaching solution may have an undesirable odor. Such pH can be obtained with substances commonly known as buffering agents, which are optional components of the bleaching compositions herein.

The following is a detailed description of the essential and the optional components of the bleaching compositions within the invention. All percentages, parts and ratios are by weight unless otherwise indicated.

The Bleach Promoter

The bleach promoters of this invention are the water-soluble sulfosuccinates, nitrilotriacetates and mixtures thereof. They are used at a level of from about ¼% to about 60%, preferably from about ½% to about 10% and most preferably from about ½% to about 5%. The cations are usually sodium or potassium, preferably sodium. Other cations including magnesium can be used, but preferably cations that react with the bleach are avoided. It is preferred that the promoter be intimately admixed with the surfactant, especially those surfactants that tend to form a middle phase since it is believed that the promoter works by increasing the rate at which the surfactant dissolves by destroying any slowly soluble phase.

The Peroxygen Bleaching Compound

The peroxygen bleaching compounds useful herein are those capable of yielding hydrogen peroxide in an aqueous solution. These compounds are well known in the art and include hydrogen peroxide and the alkali metal peroxides, organic peroxide bleaching compounds such as urea peroxide, and inorganic persalt bleachiing compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono- and tetra-hydrates, sodium carbonate peroxyhydrate, sodium pyrophosphate peroxyhydrate, urea peroxyhydrate, and sodium peroxide. Particularly preferred are sodium perborate tetrahydrate and, especially, sodium perborate monohydrate. Sodium perborate monohydrate is especially preferred because it is very stable during storage and yet still dissolves very quickly in the bleaching solution. It is believed that such rapid dissolution results in the formation of higher levels of percarboxylic acid and, thus, enhanced surface bleaching performance.

The level of peroxygen bleach within compositions of the invention is from about 0.1% to about 95% and preferably from about 1% to about 60% when an activator is used. It is preferred that the level of peroxygen bleach be from about 1% to about 20%.

The Bleach Activator

The bleach activators within the invention have the general formula:

$$R-\overset{\overset{\displaystyle O}{\|}}{C}-L$$

wherein R is an alkyl group containing from about 5 to about 18 carbon atoms wherein the longest linear alkyl chain extending from and including the carbonyl carbon contains no more than about 10 carbon atoms and L is a leaving group, the conjugate acid of which has a $pK_a$ in the range of from about 6 to about 13.

L can be essentially any suitable leaving group. A leaving group is any group that is displaced from the bleach activator as a consequence of the nucleophilic attack on the bleach activator by the perhydroxide anion. This, the perhydrolysis reaction, results in the formation of the percarboxylic acid. Generally, for a group to be a suitable leaving group it must exert an electron attracting effect. This facilitates the nucleophilic attack by the perhydroxide anion. Leaving groups that exhibit such behavior are those in which their conjugate acid has a $pK_a$ in the range of from about 6 to about 13, preferably from about 7 to about 11 and most preferably from about 8 to about 11.

Preferred bleach activators are those of the above general formula wherein R is as defined in the general formula and L is selected from the group consisting of:

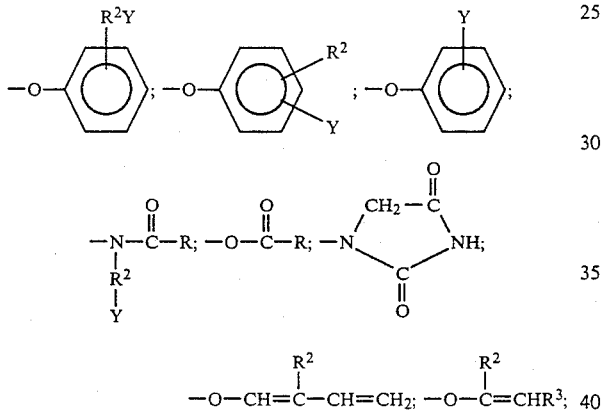

and mixtures thereof wherein R is as defined above, $R^2$ is an alkyl chain containing from about 1 to about 8 carbon atoms, $R^3$ is H or $R^2$, and Y is H or a solubilizing group. The preferred solubilizing groups are $-SO_3^-M^+$, $-COO^-M^+$, $-SO_4^-M^+$, $(-N^+R_3^4)X^-$ and $O\leftarrow NR_2^4-$ and most preferably $-SO_3^-M^+$ and/or $-COO^-M^+$ wherein $R^4$ is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing group should be well dispersed in the bleaching solution in order to assist in their dissolution.

Preferred bleach activators are also those of the above general formula wherein L is as defined in the general formula and R is an alkyl group containing from about 5 to about 12 carbon atoms wherein the longest linear alkyl chain extending from and including the carbonyl carbon contains from about 5 to about 10 carbon atoms.

Even more preferred are bleach activators of the above general formula wherein L is as defined in the general formula and R is a linear alkyl chain containing a linear portion of from about 5 to about 9 and preferably from about 6 to about 8 carbon atoms with, preferably, an alkyl group on the second or third carbon atom with respect to the carbonyl group, the total carbon atoms being from about 6 to about 12.

More preferred bleach activators are those of the above general formula wherein R is a linear or branched alkyl chain containing from about 4 to about 9 and preferably from about 6 to about 8 carbon atoms and L is selected from the group consisting of:

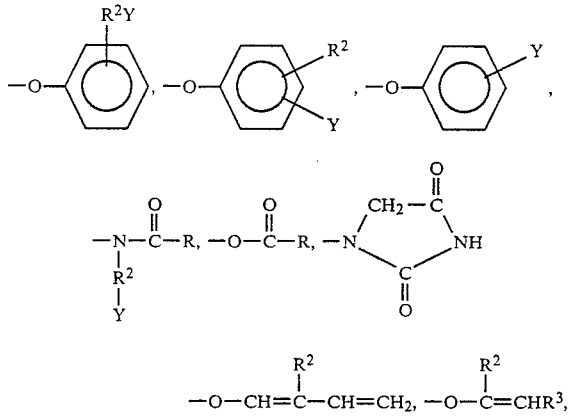

wherein R, $R^2$, $R^3$ and Y are as defined above.

Particularly preferred bleach activators are those of the above general formula wherein R is an alkyl group containing from about 5 to about 12 carbon atoms wherein the longest linear portion of the alkyl chain extending from and including the carbonyl carbon is from about 5 to about 10 carbon atoms and L is selected from the group consisting of:

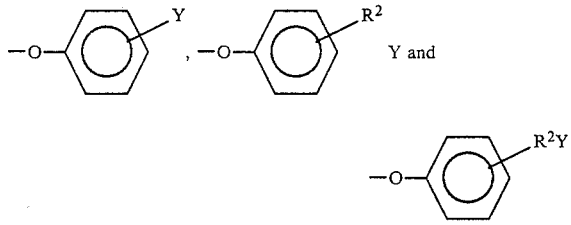

wherein $R^2$ is as defined above and Y is $-SO_3^-M^+$ or $-COO^-M^+$ wherein M is as defined above.

Especially preferred bleach activators are those of the above general formula wherein R is a linear or branched alkyl chain containing from about 5 to about 9 and preferably from about 6 to about 8 carbon atoms and L is selected from the group consisting of:

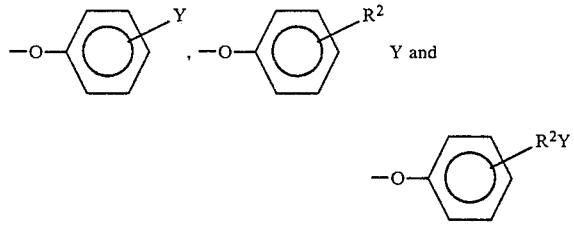

wherein $R^2$ is as defined above and Y is $—SO_3^-M^+$ or $—COO^-M^+$ wherein M is as defined above.

The most preferred bleach activators have the formula:

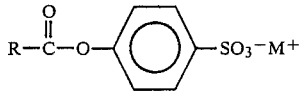

wherein R is a linear or branched alkyl chain containing from about 5 to about 12 and preferably from about 6 to about 8 carbon atoms preferably with at least one alkyl group attached to the second or third carbon atom with respect to the carbonyl groups and M is sodium or potassium.

The level of bleach activator within the compositions of the invention is from about 0.1% to about 60% and preferably from about 0.5% to about 40%. When the bleaching compositions within the invention are also detergent compositions it is preferred that the level of bleach activator is from about 0.5% to about 20%.

The corresponding percarboxylic acids, or their salts, can also be used. These peracids have the formula:

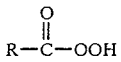

Such peracids are difficult to stabilize. The amounts used are essentially the same as for the activator, e.g., from about 0.05% to about 30%, preferably from about 0.1% to about 10%.

The total amount of available oxygen provided in percarboxylic acid form in the product is from about 0.03% to about 1.3%, preferably from about 0.07% to about 0.7%, most preferably from about 0.1% to about 0.4%.

The compositions of the invention are bleaching detergent compositions. Thus, the compositions contain detergency surfactants and, preferably, detergency builders.

The Detergent Surfactant

The detergent surfactants can be any one or more surface active agents selected from anionic, nonionic, zwitterionic, amphoteric and cationic classes and compatible mixtures thereof. Detergent surfactants useful herein are listed in U.S. Pat. No. 3,664,961, Norris, issued May 23, 1972, and in U.S. Pat. No. 3,919,678, Laughlin et al, issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference. The following are representative examples of detergent surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates (AS), especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain (LAS) or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11\text{-}13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates ($AE_xS$) containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the composition of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Preferred nonionics are the water-soluble and water-dispersible condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

The detergent surfactant of this invention is typically one that creates a middle phase upon dilution in water, especially $AE_xS$, AS, LAS, and mixtures thereof.

The level of detergent surfactant that can be employed is from 1% to about 60%, preferably from about 1% to about 30% and most preferably from about 10% to about 25% by weight of the total composition.

In addition to detergent surfactants, detergency builders can be employed in the bleaching compositions. Water-soluble inorganic or organic electrolytes are suitable builders. The builder can also be water-insoluble calcium ion exchange materials; nonlimiting examples of suitable water-soluble, inorganic detergent builders include: alkali metal carbonates, borates, phosphates, bicarbonates and silicates. Specific examples of such salts include sodium and potassium tetraborates, bicarbonates, carbonates, orthophosphates, pyrophosphates, tripolyphosphates and metaphosphates.

Examples of suitable organic alkaline detergency builders include: (1) water-soluble amino carboxylates and aminopolyacetates, for example, nitrilotriacetates, glycinates, ethylenediamine tetraacetates, N-(2-hydroxyethyl)nitrilo diacetates and diethylenetriamine pentaacetates; (2) water-soluble salts of phytic acid, for example, sodium and potassium phytates; (3) water-soluble polyphosphonates, including sodium, potassium, and lithium salts of ethane-1-hydroxy-1, 1-diphosphonic acid; sodium, potassium, and lithium salts of ethylene diphosphonic acid; and the like; (4) water-soluble polycarboxylates such as the salts of lactic acid, succinic acid, malonic acid, maleic acid, citric acid, carboxymethyloxysuccinic acid, 2-oxa-1,1,3-propane tricarboxylic acid, 1,1,2,2-ethane tetracarboxylic acid, mellitic acid and pyromellitic acid; and (5) water-soluble polyacetals as disclosed in U.S. Pat. Nos. 4,144,266 and 4,246,495 incorporated herein by reference.

Another type of detergency builder material useful in the present compositions comprises a water-soluble material capable of forming a water-insoluble reaction product with water hardness cations preferably in combination with a crystallization seed which is capable of providing growth sites for said reaction product. Such "seeded builder" compositions are fully disclosed in British Patent Specification No. 1,424,406.

A further class of detergency builder materials useful in the present invention are insoluble sodium aluminosilicates, particularly those described in Belgian Pat. No. 814,874, issued Nov. 12, 1974, incorporated herein by reference. This patent discloses and claims detergent compositions containing sodium aluminosilicates having the formula:

$$Na_z(AlO_2)_z(SiO_2)_yXH_2O$$

wherein z and y are integers equal to at least 6, the molar ratio of z to y is in the range of from 1.0:1 to about 0.5:1, and X is an integer from about 15 to about 264, said aluminosilicates having a calcium ion exchange capacity of at least 200 milligrams equivalent/gram and a calcium ion exchange rate of at least about 2 grains/gallon/minute/gram. The particle size is from about 0.1 to about 25 microns, preferably from about one to about 10 microns. A preferred material is Zeolite A which is:

$$Na_{12}(SiO_2AlO_2)_{12}27H_2O$$

The level of detergency builder of the bleaching compositions is from 0% to about 70%, preferably from about 10% to about 60% and most preferably from about 20% to about 60%.

The bleaching detergent compositions of this invention can contain all of the usual components of detergent compositions including the ingredients set forth in U.S. Pat. No. 3,936,537, Baskerville et al, incorporated herein by reference. Such components include color speckles, suds boosters, suds suppressors, antitarnish and/or anticorrosion agents, soil-suspending agents, soil-release agents, dyes, fillers, optical brighteners, germicides, alkalinity sources, hydrotropes, antioxidants, enzymes, enzyme stabilizing agents, perfumes, etc.

Buffering agents can be utilized to maintain the desired alkaline pH of the bleaching solutions. Buffering agents include, but are not limited to many of the detergency builder compounds disclosed hereinbefore. Buffering agents suitable for use herein are those well known in the detergency art.

Preferred optional ingredients include suds modifiers particularly those of suds suppressing types, exemplified by silicones, and silica-silicone mixtures.

U.S. Pat. No. 3,933,672, issued Jan. 20, 1976 to Bartolotta et al, and No. 4,136,045, issued Jan. 23, 1979 to Gault et al, incorporated herein by reference, disclose silicone suds controlling agents. The silicone material can be represented by alkylated polysiloxane materials such as silica aerogels and xerogels and hydrophobic silicas of various types. The silicone material can be described as siloxane having the formula:

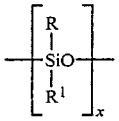

wherein x is from about 20 to about 2,000 and R and $R^1$ are each alkyl or aryl groups, especially methyl, ethyl, propyl, butyl and phenyl. The polydimethylsiloxanes (R and $R^1$ are methyl) having a molecular weight within the range of from about 200 to about 2,000,000, and higher, are all useful as suds controlling agents. Additional suitable silicone materials wherein the side chain groups R and $R^1$ are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpoly-siloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially nonsurface-active detergent-impermeable carrier.

Particularly useful suds suppressors are the self-emulsifying silicone suds suppressors, described in U.S. Pat. No. 4,073,118, Gault et al, issued Feb. 21, 1978, incorporated herein by reference. An example of such a compound is DB-544, commercially available from Dow Corning, which is a siloxane/glycol copolymer.

Suds modifiers as described above are used at levels of up to approximately 2%, preferably from about 0.1 to about 1½% by weight of the surfactant.

Microcrystalline waxes having a melting point in the range from 35° C.–115° C. and a saponification value of less than 100 represent additional examples of preferred suds control components for use in the subject compositions, and are described in detail in U.S. Pat. No. 4,056,481, Tate, issued Nov. 1, 1977, incorporated herein by reference. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 77° F. by ASTM-D1321. Suitable examples of the above waxes include: microcrystalline and oxidized microcrystalline petroleum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds control agent for use herein. These preferred phosphate esters are predominantly monostearyl phosphate which, in addition thereto, can contain di- and tristearyl phosphates and monooleyl phosphate, which can contain di- and trioleyl phosphate.

Other suds control agents useful in the practice of the invention are the soap or the soap and nonionic mixtures as disclosed in U.S. Pat. Nos. 2,954,347 and 2,954,348, incorporated herein by reference.

The following examples are given to illustrate the parameters of and compositions within the invention. All percentages, parts and ratios are by weight unless otherwise indicated.

In Examples I and II, the performance was tested as follows: 5"×5" swatches of standard textiles were soiled with various stains of the bleach sensitive type. Each swatch was split in half with half of the stain on each swatch and each half was washed in a different treatment. In addition, soiled dingy consumer items were split in half and each half was washed in a different treatment. Since one swatch or garment can only be used to compare two treatments, for, e.g., three treatments, there would be three swatches to make all possible comparisons, as follows.

| Swatch/Garment Number | Treatment Comparison |
|---|---|
| 1 | AB |
| 2 | AC |
| 3 | BC |

The number of swatches/garments per load were twice that listed above.

Laundry loads were prepared containing the half swatches representing five bleach sensitive soils and half consumer items representing two dingy garments. The remainder of the loads were soiled consumer laundry. The fabric load was 5% of the wash solution.

Each load was then washed with a quantity of an individual composition that corresponds to detergent concentrations utilized in conventional automatic wash processes. Full scale top loading automatic washing machines were used. The wash water had a temperature of 95° F. and contained 5 grains/gallon water hardness.

This wash process was repeated so that the number of replicates equals the number of treatments.

Each of the half swatches and half garments was then comparison graded against its identical counterpart that had been washed with a different detergent composition to determine relative soil removal. A grading scale of −4 to 4 was used, with −4 indicating much less soil removal, 0 indicating no difference and 4 indicating much more soil removal.

The treatment grades for each replicate are averaged across all bleach sensitive stain types and dingy garments and then the replicate averages are averaged to give a treatment mean for each detergent composition. This average is known as the Cleaning Index.

EXAMPLE I

Wash water solutions were prepared that represented the following compositions:

| | % A | % B | % C | % D | % E |
|---|---|---|---|---|---|
| Sodium $C_{14-15}$ alkyl sulfate ($C_{14-15}$AS) | 7.5 | 7.5 | 7.5 | 7.5 | 7.5 |
| Sodium $C_{13}$ linear alkylbenzene sulfonate ($C_{13}$LAS) | 7.5 | 7.5 | 7.5 | 7.5 | 7.5 |

-continued

| | % A | % B | % C | % D | % E |
|---|---|---|---|---|---|
| $C_{9-11}$ alkyl polyethoxylate$_{2.5T}$* ($C_{12-13}E_{6.5}T$) | 2.0 | 2.0 | 2.0 | 2.0 | 2.0 |
| $C_{12}$ alkyltrimethyl ammonium chloride ($C_{12}$TMAC) | 2 | 1.0 | 0 | 1.0 | 0 |
| Sodium tripolyphosphate (STPP) | 31.6 | 31.6 | 31.6 | 31.6 | 31.0 |
| Sodium sulfosuccinate (SSS) | 0 | 2.0 | 2.0 | 0 | 0 |
| Sodium toluene sulfonate (STS) | 2.0 | 0.7 | 0.7 | 2.0 | 2.0 |
| Sodium carbonate | 12.0 | 12.0 | 12.0 | 12.0 | 12.0 |
| Sodium perborate | 5.1 | 5.1 | 5.1 | 5.1 | 5.1 |
| Sodium octanoyloxybenzene sulfonate | 7.7 | 7.7 | 7.7 | 7.7 | 7.7 |
| Sodium silicate (1.6r) | 3.0 | 3.0 | 3.0 | 3.0 | 7.0 |
| Water | 7.0 | 7.0 | 7.0 | 7.0 | 7.0 |
| Miscellaneous (e.g., perfume, sodium sulfate, suds suppressor, optical brightener, etc.) | | | Balance | | |

*Stripped of lower ethoxylated fractions and fatty alcohol.

In each of the comparisons the compositions representing the invention (B and C) containing the specific hydrotrope of this invention provided significantly more cleaning than the corresponding compositions A, D, and E which did not contain sodium sulfosuccinate.

Similar results are obtained when the sulfosuccinate is replaced with an equivalent amount of a sodium or potassium nitrilotriacetate especially when the sulfosuccinate and/or nitrilotriacetate is intimately admixed with the surfactants.

| | A | B | C | D | E |
|---|---|---|---|---|---|
| Cleaning Index | Base | 0.5 | 0.7 | −0.3 | 0.0 |
| Average $LSD_{0.1}$ | | 0.4 | 0.4 | 0.3 | 0.3 |

EXAMPLE II

Low Levels of Sodium Sulfosuccinate Improves Cleaning On Bleach Sensitive Stains Wash water solutions were prepared that represented the following compositions:

| | A | B |
|---|---|---|
| Sodium $C_{13}$ linear alkylbenzene sulfonate ($C_{13}$LAS) | 7.5 | 7.5 |
| Sodium $C_{14-15}$ alkyl sulfate | 7.5 | 7.5 |
| $C_{12}$ alkyltrimethylammonium chloride ($C_{12}$TMAC) | 2.0 | 2.0 |
| $C_{12-13}E_{6.5}T$ | 2.0 | 2.0 |
| Sodium toluene sulfonate | 0.7 | 0.7 |
| Sodium sulfosuccinate | 2.0 | 1.0 |
| Sodium tripolyphosphate | 31.6 | 31.6 |
| Sodium carbonate | 12.0 | 12.0 |
| Sodium perborate solids | 5.1 | 5.1 |
| Sodium sulfophenyl octoneate | 7.7 | 7.7 |
| Sodium silicate solids, 1.6r | 3.0 | 3.0 |
| Optical brightener | 0.2 | 0.2 |
| Suds suppressor | 0.3 | 0.3 |
| Water | 7.0 | 7.0 |
| Sodium sulfate | Balance | Balance |
| Cleaning Index | 1.5 | 1.5 |

-continued

| | A | B |
|---|---|---|
| Average $LSD_{0.1}$ | 0.4 | 0.4 |

A comparison of the compositions shows that performance is similar across a range of sulfosuccinate levels and that the invention provides a significant benefit versus the control product which was a commercially effective detergent product.

EXAMPLE III

The following granular detergent compositions were prepared:

| | A % | B % |
|---|---|---|
| Sodium $C_{16-18}$ alkyl sulfate | 5.5 | 0 |
| Sodium $C_{12}$ linear alkylbenzene sulfonate | 3.5 | 0 |
| Sodium $C_{13}$ linear alkylbenzene sulfonate | 0 | 7.1 |
| Sodium $C_{14-15}$ alkyl sulfate | 0 | 10.7 |
| $C_{14-16}$ alkyl polyethoxylate$_{2.25}$ | 5.5 | 0 |
| $C_{12}$ alkyl trimethyl ammonium chloride | 0 | 3.2 |
| $C_{9-11}$ alkyl polyethoxylate$_{2.5T}$ | 0 | 1.6 |
| Sodium tripolyphosphate | 24.4 | 38.0 |
| Sodium nitrilotriacetate | 0 | 4.1 |
| Zeolite A | 17.6 | 0 |
| Sodium carbonate | 10.5 | 12.0 |
| Sodium silicate (2.0r) | 1.9 | 0 |
| Sodium silicate (1.6r) | 0 | 1.9 |
| Sodium sulfate | 21.0 | 10.7 |
| Sodium perborate | 5.1 | 5.1 |
| Sodium octanoyloxybenzene sulfonate | 7.7 | 7.7 |
| Water | 8.9 | 8.5 |
| Miscellaneous | 1.2 | 1.8 |

What is claimed is:

1. A bleaching detergent composition comprising:

I. a bleaching system to give from about 0.03% to about 1.3% available oxygen in the composition, based upon the theoretical amount of percarboxylic acid, and being selected from the group consisting of:

(a) a mixture of a peroxygen bleaching compound capable of yielding hydrogen peroxide in an aqueous solution; and a bleach activator having the general formula:

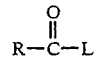

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 6 to about 13; or (b) a percarboxylic acid having the general formula

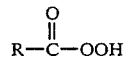

wherein R has the meaning given hereinbefore or mixtures thereof;

II. from about 1% to about 60% of a detergent surfactant; and

III. at least about ¼% of a water-soluble sulfosuccinate.

2. The composition of claim 1 wherein said detergent surfactant tends to form a middle phase upon the dilution of the composition in water and there is from about ½% to about 10% of said bleach promoter.

3. The composition of claim 2 wherein the bleach promoter is intimately mixed in the detergent surfactant and the cation is sodium, potassium or mixtures thereof.

4. The composition of claim 2 wherein the peroxygen bleaching compound is selected from the group consisting of sodium perborate monohydrate, sodium perborate tetrahydrate, sodium carbonate peroxyhydrate, sodium pyrophosphate peroxyhydrate, urea peroxyhydrate, sodium peroxide and mixtures thereof.

5. The composition of claim 4 wherein the peroxygen bleaching compound is selected from the group consisting of sodium perborate monohydrate, sodium perborate tetrahydrate and mixtures thereof.

6. The composition of claim 5 wherein L is a leaving group, the conjugate acid of which has a $pK_a$ in the range of from about 7 to about 11.

7. The composition of claim 6 wherein L is a leaving group, the conjugate acid of which has a $pK_a$ in the range of from about 8 to about 11.

8. The composition of claim 6 wherein L is selected from the group consisting of:

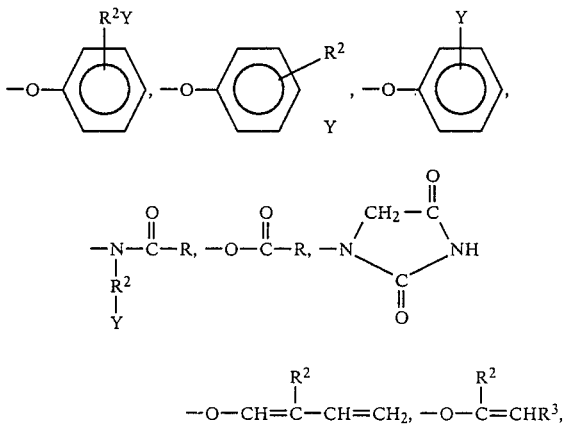

wherein R is as defined in claim 1, $R^2$ is an alkyl chain containing from about 1 to about 8 carbon atoms, $R^3$ is H or $R^2$, and Y is H or a solubilizing group.

9. The composition of claim 8 wherein R is an alkyl group containing from about 5 to about 12 carbon atoms wherein the longest linear alkyl chain extending from and including the carbonyl carbon contains from about 6 to about 10 carbon atoms and L has the general formula

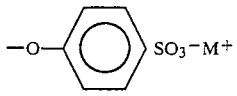

wherein M is sodium or potassium.

10. The composition of claim 2 wherein the bleach system is a percarboxylic acid having the formula

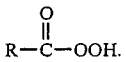

11. The composition of claim 2 wherein the bleach promoter is intimately mixed in the detergent surfactant and the cation is sodium, potassium or mixtures thereof.

12. The composition of claim 2 wherein the peroxygen bleaching compound is selected from the group consisting of sodium perborate monohydrate, sodium perborate tetrahydrate, sodium carbonate peroxyhydrate, sodium pyrophosphate peroxyhydrate, urea peroxyhydrate, sodium peroxide and mixtures thereof.

13. The composition of claim 12 wherein the peroxygen bleaching compound is selected from the group consisting of sodium perborate monohydrate, sodium perborate tetrahydrate and mixtures thereof.

14. The composition of claim 13 wherein L is a leaving group, the conjugate acid of which has a $pK_a$ in the range of from about 7 to about 11.

15. The composition of claim 14 wherein L is a leaving group, the conjugate acid of which has a $pK_a$ in the range of from about 8 to about 11.

16. The composition of claim 14 wherein L is selected from the group consisting of:

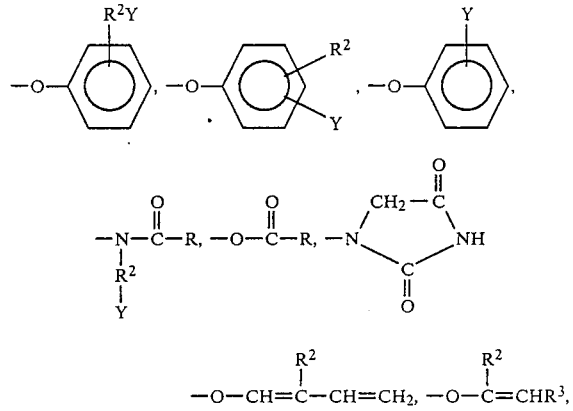

wherein R is as defined in claim 1, $R^2$ is an alkyl chain containing from about 1 to about 8 carbon atoms, $R^3$ is H or $R^2$, and Y is H or a solubilizing group.

17. The composition of claim 16 wherein R is an alkyl group containing from about 5 to about 12 carbon atoms wherein the longest linear alkyl chain extending from and including the carbonyl carbon contains from about 6 to about 10 carbon atoms and L has the general formula

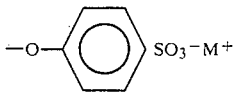

wherein M is sodium or potassium.

18. The composition of claim 2 wherein the bleach system is a percarboxylic acid having the formula

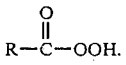

* * * * *